US008256519B2

(12) United States Patent
Friedemann

(10) Patent No.: US 8,256,519 B2
(45) Date of Patent: Sep. 4, 2012

(54) SYSTEM AND METHOD FOR SUB-COOLING HYDROCARBON PRODUCTION FLUID FOR TRANSPORT

(76) Inventor: John Daniel Friedemann, Gjettum (NO)

( * ) Notice: Subject to any disclaimer, the term of this patent is extended or adjusted under 35 U.S.C. 154(b) by 381 days.

(21) Appl. No.: 12/502,256

(22) Filed: Jul. 14, 2009

(65) Prior Publication Data

US 2010/0012325 A1 Jan. 21, 2010

Related U.S. Application Data

(60) Provisional application No. 61/081,525, filed on Jul. 17, 2008.

(51) Int. Cl.
*E21B 7/12* (2006.01)

(52) U.S. Cl. ..... 166/335

(58) Field of Classification Search ..... 166/302, 166/84.2

See application file for complete search history.

(56) References Cited

U.S. PATENT DOCUMENTS

| | | | | |
|---|---|---|---|---|
| 3,384,169 | A * | 5/1968 | Leonard | 166/357 |
| 3,768,559 | A | 10/1973 | Allen et al. | |
| 3,900,041 | A | 8/1975 | Kersch et al. | |
| 3,910,299 | A | 10/1975 | Tackett et al. | |
| 4,697,426 | A | 10/1987 | Knowles et al. | |
| 5,888,407 | A | 3/1999 | Benson | |
| 6,070,417 | A | 6/2000 | Benson | |
| 6,227,039 | B1 * | 5/2001 | Te'eni | 73/54.03 |
| 6,350,928 | B1 * | 2/2002 | Waycuilis et al. | 585/15 |
| 6,656,366 | B1 | 12/2003 | Fung et al. | |
| 6,703,534 | B2 * | 3/2004 | Waycuilis et al. | 585/15 |
| 7,597,148 | B2 * | 10/2009 | O'Malley et al. | 166/304 |
| 7,866,385 | B2 * | 1/2011 | Lambirth | 166/256 |
| 2003/0056954 | A1 | 3/2003 | Headworth | |
| 2003/0062063 | A1 | 4/2003 | Sandu et al. | |
| 2004/0235675 | A1 * | 11/2004 | Qiu | 507/200 |
| 2005/0145388 | A1 * | 7/2005 | Hopper | 166/357 |
| 2006/0175062 | A1 | 8/2006 | Benson | |
| 2006/0186023 | A1 * | 8/2006 | Balkanyi et al. | 208/263 |
| 2006/0204375 | A1 * | 9/2006 | Judge et al. | 417/393 |
| 2006/0272805 | A1 * | 12/2006 | O'Malley et al. | 166/177.2 |
| 2007/0123431 | A1 * | 5/2007 | Jones et al. | 507/209 |
| 2007/0276169 | A1 * | 11/2007 | Tohidi et al. | 585/15 |
| 2009/0078406 | A1 * | 3/2009 | Talley et al. | 166/177.3 |
| 2009/0273112 | A1 * | 11/2009 | Boothe et al. | 264/148 |

FOREIGN PATENT DOCUMENTS

GB 2274898 8/1994

(Continued)

*Primary Examiner* — Thomas Beach
*Assistant Examiner* — Aaron Lembo
(74) *Attorney, Agent, or Firm* — Bracewell & Giuliani LLP

(57) ABSTRACT

A technique is provided for producing a slurry of solid particulates and hydrocarbon production fluid for transport via a subsea flow line. The technique utilizes a cold flow system that cools production fluid to a temperature below the temperature at which hydrates and other substances precipitate from the production fluid and form solid particulates. An instrumentation and control system is used to receive and process data from sensors in the system. The instrumentation and control system then provides control signals to one or more components of the cold flow system to produce a slurry having solid particulates with desirable characteristics. In addition, a cooling gas may be used to facilitate sub-cooling of the production fluid. The cooling gas is compressed and cools the production fluid as the gas expands via Joule-Thompson expansion. Furthermore, a discharge pressure controller may be used to control flow through the cold flow system.

21 Claims, 5 Drawing Sheets

FOREIGN PATENT DOCUMENTS

| | | | |
|---|---|---|---|
| WO | WO 9203521 | | 3/1992 |
| WO | WO 9810036 | | 3/1998 |
| WO | WO 02092961 | | 11/2002 |
| WO | WO 2008/056252 | A3 | 5/2005 |
| WO | WO 2006068929 | | 6/2006 |
| WO | WO 2008/051087 | | 5/2008 |
| WO | WO 2008/056248 | A3 | 5/2008 |
| WO | WO 2008/056252 | A3 | 5/2008 |

* cited by examiner

SYSTEM AND METHOD FOR SUB-COOLING HYDROCARBON PRODUCTION FLUID FOR TRANSPORT

FIELD OF THE INVENTION

The present invention relates to a system and method for reducing or eliminating the buildup of solids, such as paraffin's, in a subsea flow line transporting hydrocarbon fluids. In particular, the present invention relates to a system and method for controlling the production of a slurry of solid particles in hydrocarbon production fluid so as to reduce or eliminate the buildup of solids along a subsea flow line transporting the hydrocarbon production fluid from a wellbore.

BACKGROUND

One of the most challenging issues in transporting hydrocarbon fluids over long distances under water is the formation and crystallization of solids inside the production tubing used to transport the hydrocarbons. In addition to oil or gas, the hydrocarbon fluids produced from a well typically contain water, gas, and dissolved solids. The dissolved solids may include waxes, organic salts, and inorganic salts.

For various reasons, a layer of solids may buildup in the production tubing transporting the hydrocarbon fluids. The buildup of solids within the production tubing may lead to a loss or reduction in the flow of oil or gas through the production tubing. The solids may be formed from several different substances. For example, the solids may be hydrates formed from a mixture of gas and water, wax, asphaltenes, or organic and inorganic salts. These solids are dissolved in the production fluid at production temperature and then precipitate from the production fluid at temperatures below the production temperatures or pressure. For example, the dissolved solids may precipitate from the hydrocarbon fluid as a result of a reduction in the temperature of the fluid, such as ice forming in water cooled below the freezing point of water. In addition, a change in pressure of the hydrocarbon fluid can cause the dissolved solids to precipitate from the hydrocarbon fluid. Chemical changes in the hydrocarbon fluid can also cause the dissolved solids to precipitate out of the hydrocarbon fluid.

A reduction or loss of flow caused by the buildup of solids within a flow line may require extensive remediation efforts. For example, a flow line with a buildup of solids may need to be jetted, drilled, or treated with heat or chemicals to dissolve the solids and return the flow line to its original condition. Such remediation efforts are time-consuming and expensive.

Several approaches have been attempted to overcome this problem. For example, several technologies have been developed that either heat the flow line for production fluid or insulate the flow lines in an attempt to keep the temperature and pressure of the production fluid out of the region where the formation of solids may occur.

An alternative approach that has been attempted is to accept that there will be heat and pressure losses associated with flowing production fluid through production tubing extending along the seafloor and to try to control the process of the formation of solids within the flow line. This solution generally is referred to as "cold flow" or "sub-cooled flow" technology. In cold flow systems, the production fluid is cooled at an upstream location to a temperature where solids will precipitate from the production fluid. From there, the solids are transported with the production fluid as slurry. A slurry is a suspension of solids in a liquid. The solids in the slurry are less likely to buildup in the flow line than are solids that precipitate out of the fluid at various points along the flow line.

There are several drawbacks and problems associated with existing cold-flow systems. Primarily, these systems are complex, unstable, and provide unsatisfactory results. In particular, controlling the formation of solids so that the solids do not buildup in the system or flow line has proven to be difficult.

Therefore, a more effective technique is desired for providing a cold-flow of hydrocarbon products. In particular, a cold-flow technique is desired that would enable a hydrocarbon slurry to be formed in a subsea flow line and transported to a desired destination without adhesion to the walls of the flow line.

BRIEF DESCRIPTION

A technique is provided for producing a slurry of solid particulates and hydrocarbon production fluid for transport via a subsea flow line. The technique utilizes a cold flow system that cools production fluid to a temperature below the temperature at which hydrates and other substances precipitate from the production fluid and form solid particulates. The system is operable to establish at least one characteristic of the solid particulates formed in the production fluid, such as the size and/or number of solid particulates in the production fluid. The system may use a variety of different types and number of sensors, such as flow meters and particle counters, to establish the characteristics of the solid particulates in the production fluid. In addition, the system is operable to control the operation of the system based on the characteristics of the solid particulates and, thereby, control the properties of the slurry of solid particulates and hydrocarbon production fluid produced by the system.

A cooling gas may be used to facilitate sub-cooling of the production fluid. The cooling gas is compressed and cools the production fluid as the gas expands via Joule-Thompson expansion. The cooling gas provides additional sub-cooling of the production fluid.

In addition, a discharge pressure controller may be used to control the size and/or number of solid particulates in the cold flow system. The discharge pressure controller may be used to control flow through the system and, thereby, control the formation of solid particulates in the slurry.

An instrumentation and control system is used to receive and process data from the sensors. The instrumentation and control system then provides control signals to one or more components of the cold flow system to produce a slurry having solid particulates with desirable characteristics. For example, the instrumentation and control system may control the operation of the cold flow system to reduce the number and/or size of solid particulates based on the data received from the sensors.

DRAWINGS

These and other features, aspects, and advantages of the present invention will become better understood when the following detailed description is read with reference to the accompanying drawings in which like characters represent like parts throughout the drawings, wherein.

Figure 4:
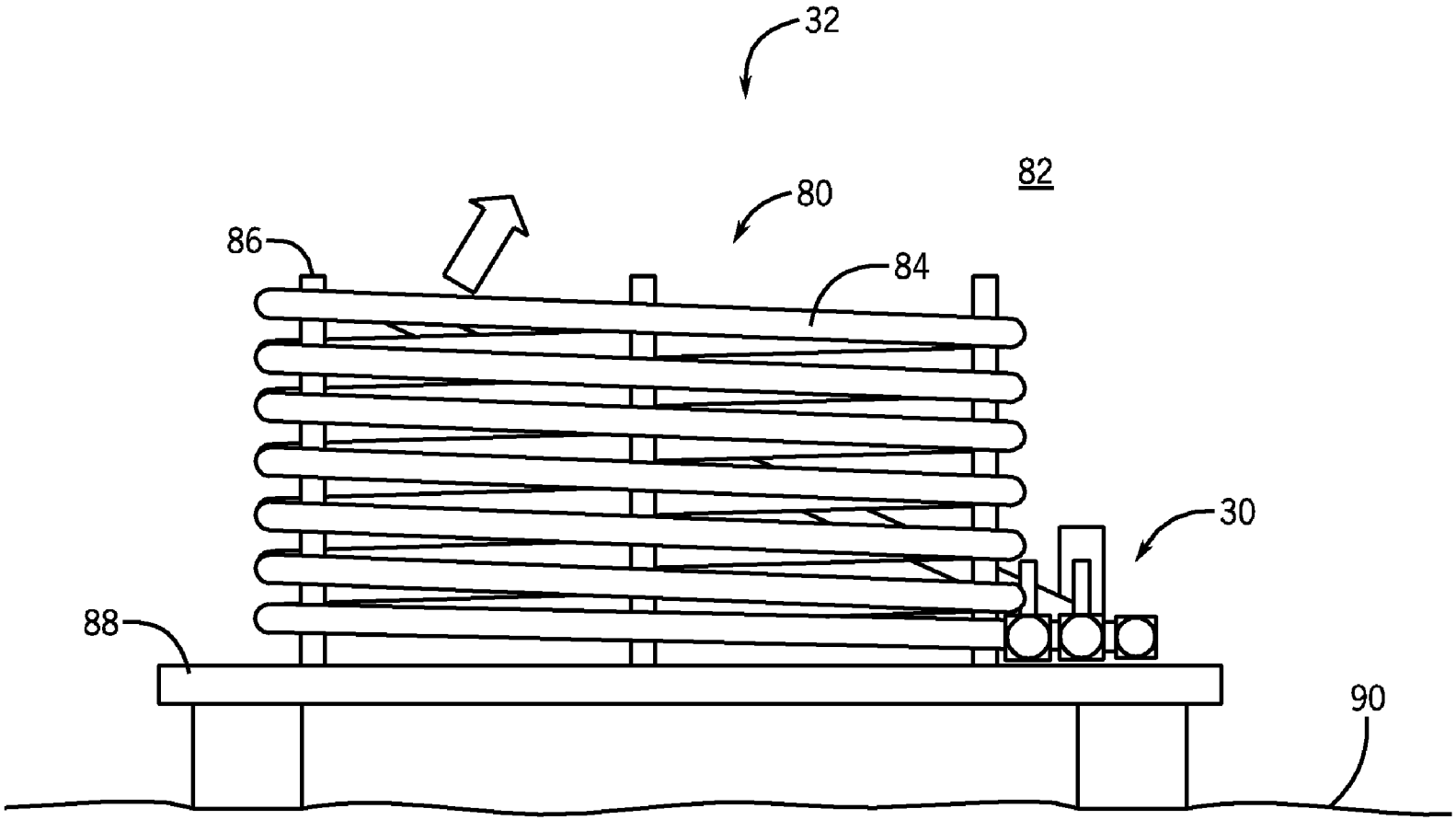
Figure 5:
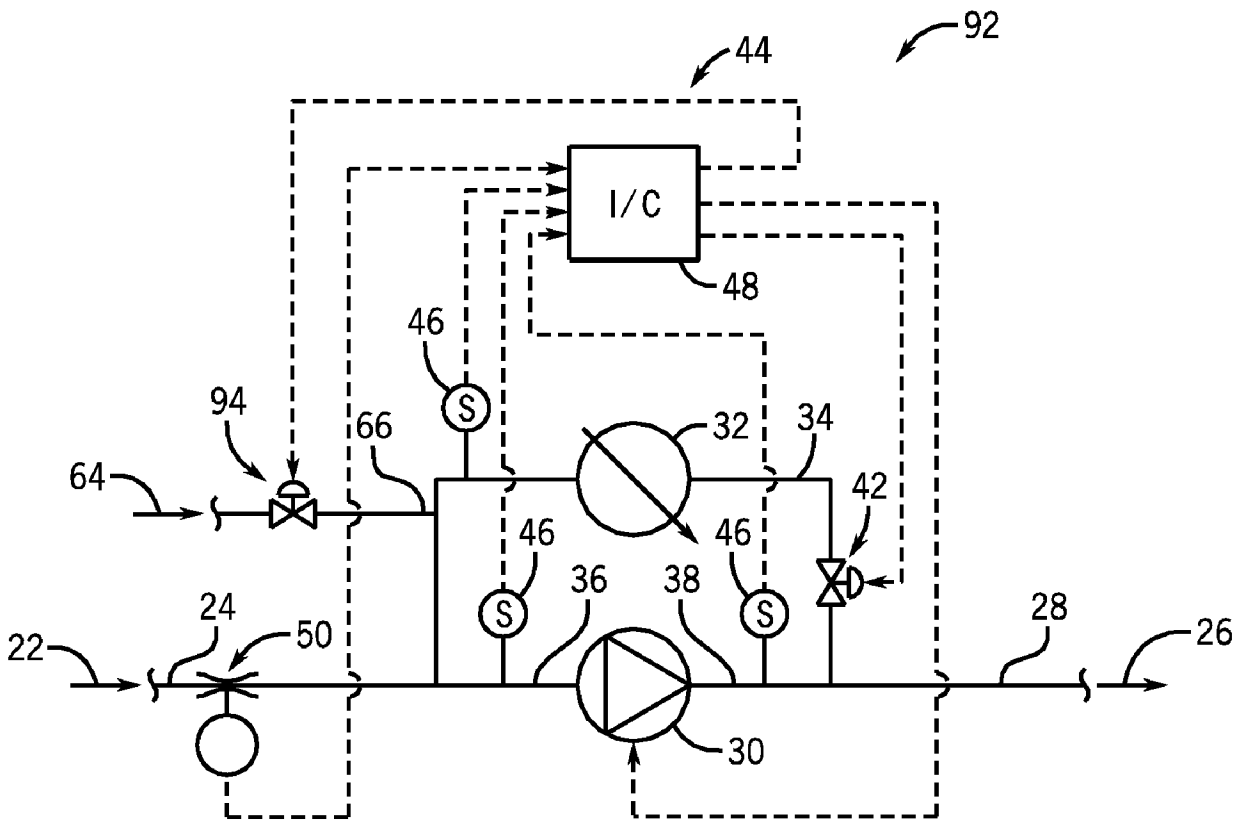

FIG. 4 is an elevation view of a cooling loop of a system for producing a flow of production fluid from a wellbore cooled below the formation temperature for hydrates, in accordance with an exemplary embodiment of the present technique; and FIG. 5 is a schematic view of an alternative embodiment of a system for producing a flow of production fluid from a wellbore that is cooled below the formation temperature for hydrates, in accordance with an exemplary embodiment of the present technique.

DETAILED DESCRIPTION

Figure 1:
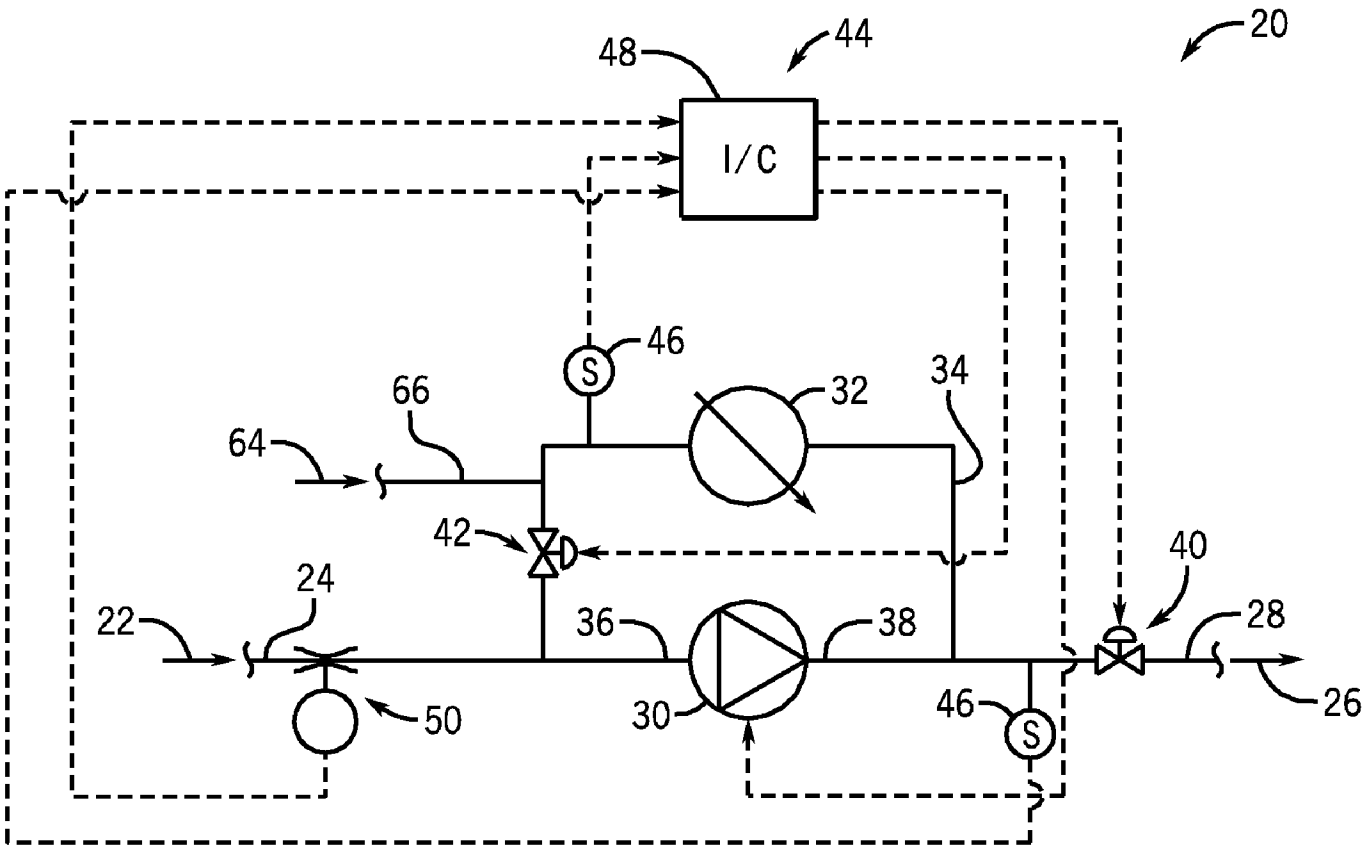
FIG. 1 is a schematic view of a system for producing a flow of production fluid from a wellbore that is cooled below the formation temperature for hydrates, in accordance with an exemplary embodiment of the present technique.

Referring now to FIG. 1, the present invention will be described as it might be applied in conjunction with an exemplary technique, in this case, a system for producing a flow of production fluid from a subsea wellbore that is cooled from a temperature above the temperature at which hydrates may become solids to a temperature below the temperature at which hydrates in the production fluid may become solid, as represented generally by reference numeral 20. As a result of the temperature decrease, the hydrates in the production fluid may become solids. However, as will be discussed in more detail below, the sub-cooling system 20 controls the formation of the hydrate solids so that the particle size of the hydrate solids remain sufficiently small that they do not build-up as a solid layer within the sub-cooling system 20 or in the flow lines downstream of the sub-cooling system 20. As a result, the sub-cooled fluid may be transported distances of many miles without the problems associated with the build-up of a solid layer of hydrates in the flow line.

The production fluid 22 enters the sub-cooling system 20 through an inlet flow line 24. The production fluid 22 exits as a slurry 26 of hydrate particles and fluids through a discharge line 38. In the illustrated embodiment, the production fluid 22 entering the systems is at a temperature that is above the temperature at which hydrates in the sub-cooling system are solid, i.e., above the formation temperature of the hydrates for the pressure of the production fluid. The sub-cooling system 20 cools the production fluid 22 entering the system to a temperature that is below the temperature at which hydrates in the sub-cooling system become solid, i.e., below the formation temperature of the hydrates for the given pressure of the production fluid from a wellbore. As a result, hydrate particles are precipitated from the production fluid 22. The hydrate particles are mixed with the remaining fluid portion of the production fluid 22, producing a slurry 26 of solid hydrate particles and production fluid.

To prevent the buildup of hydrates in the inlet flow line 22, the inlet flow line 22 is insulated to maintain the temperature of the production fluid 22 entering the system 20 above the formation temperature of the hydrates. However, a portion of the inlet flow line 22 may not have insulation or have a lesser amount of insulation to begin the cooling process. Conversely, the discharge flow line 24 is un-insulated to enable heat to escape the production fluid in the discharge flow line 24 and maintain the production fluid below the temperature at which hydrates become solid. For example, if, downstream of the sub-cooling system 20, the temperature of the production fluid were to rise above the melting point of the hydrates, the hydrate particles may melt and return to a liquid form. If the production fluid was then cooled back below the formation temperature of the hydrates, the hydrates could then re-solidify, potentially causing a buildup of a layer of solids within the flow line that could interfere with the flow of production fluid.

In the illustrated embodiment, the sub-cooling system 20 comprises a pump 30 and a cooling unit 32 located in a bypass flow line 34. The pump 30 has an inlet 36 and a discharge 38. A portion of the flow from the discharge 38 of the pump 30 is diverted to flow through the bypass flow line 34. This portion of the production fluid is cooled below the formation temperature for hydrate solids by the cooling unit 32. The hydrates precipitate from the production fluid and both the hydrates and cooled production fluid are reintroduced into the flow of production fluids upstream of the pump 30. The pump 30 macerates the hydrate particle, thereby reducing the size of the particles floating in the slurry 26. As discussed above, the product of the system 20 is a slurry 26 that is discharged via the discharge flow line 28.

A discharge pressure controller 40 is used in this embodiment to regulate the discharge pressure of the system 20 so that a desired flow of fluid through the bypass flow line 34 is produced. In addition, a recycle valve 42 is used to control the reintroduction of the sub-cooled fluid in the bypass 34 into the inlet 36 of the pump 30. As will be discussed in more detail below, one or both of these valves may be controlled automatically to regulate the size of hydrate particles in the slurry 26 discharged from the sub-cooling system 20.

In the illustrated embodiment, the sub-cooling system 20 has an instrumentation and control system 44 that is adapted to control the operation of the system 20 so that the hydrate particles that are precipitated during sub-cooling have a small and transportable size. The instrumentation and control system 44 has sensors 46 that are used to establish the characteristics of the slurry, such as the size and/or number of hydrate particles in the slurry. Various technologies may be used to establish the characteristics of the slurry. In particular, various technologies may be used to establish the characteristics of the hydrate particulate in the slurry. For example, devices that utilize electromagnetic radiation, sound, optical, and/or radioactive sensors may be used. These devices may use sources and/or detectors of microwaves, X-rays, gamma rays, neutrons, etc. The data from these various devices may be used to identify and differentiate hydrate particulates from other particulates in the slurry. In addition, the data may include the number, size, and/or any other desirable characteristic that may be used to characterize the particulates in the slurry.

The instrumentation and control system 44 also receives data from a multi-phase flow meter 50 in this embodiment. Data from the various sensors is coupled to an instrumentation and control unit 48 that processes the data to establish the characteristics of the hydrate particles in the system 20. If the hydrate particles are too large, the instrumentation and control system 44 controls the operation of the system 20 to reduce the size of the hydrate particles in the sub-cooling system 20.

The discharge pressure valve 40 and the recycle valve 42 are electrically-operated valves that are controlled by the instrumentation and control system 44 in this embodiment. The valves may be operated to control flow in the bypass line 34, which will control the flow of slurry 26 from the system 20. If the hydrate particle size in the slurry 26 is too large, the valves may be operated to reduce, or even block, flow from the system. This may provide the pump 30 with an additional opportunity to macerate the hydrate particles and, thereby, reduce the size of the hydrate particles. In addition, the speed of the pump 30 is controlled by the instrumentation and control system 44 in this embodiment. By increasing the speed of the pump 30, the maceration of the hydrate particles may be increased.

The sensors 46 may utilize several different types of technology to characterize the hydrate particles in the sub-cooling system 20. For example, a particle counting technology may be used. Alternatively, Theological properties of the slurry may be used to characterize the hydrate particles in the slurry. Rheology is the study of the deformation and flow of matter under the influence of an applied stress, such as a shear stress or an extensional stress. Viscosity is an example of a Theological property of a fluid or slurry, as is the Reynolds number.

Figure 2:
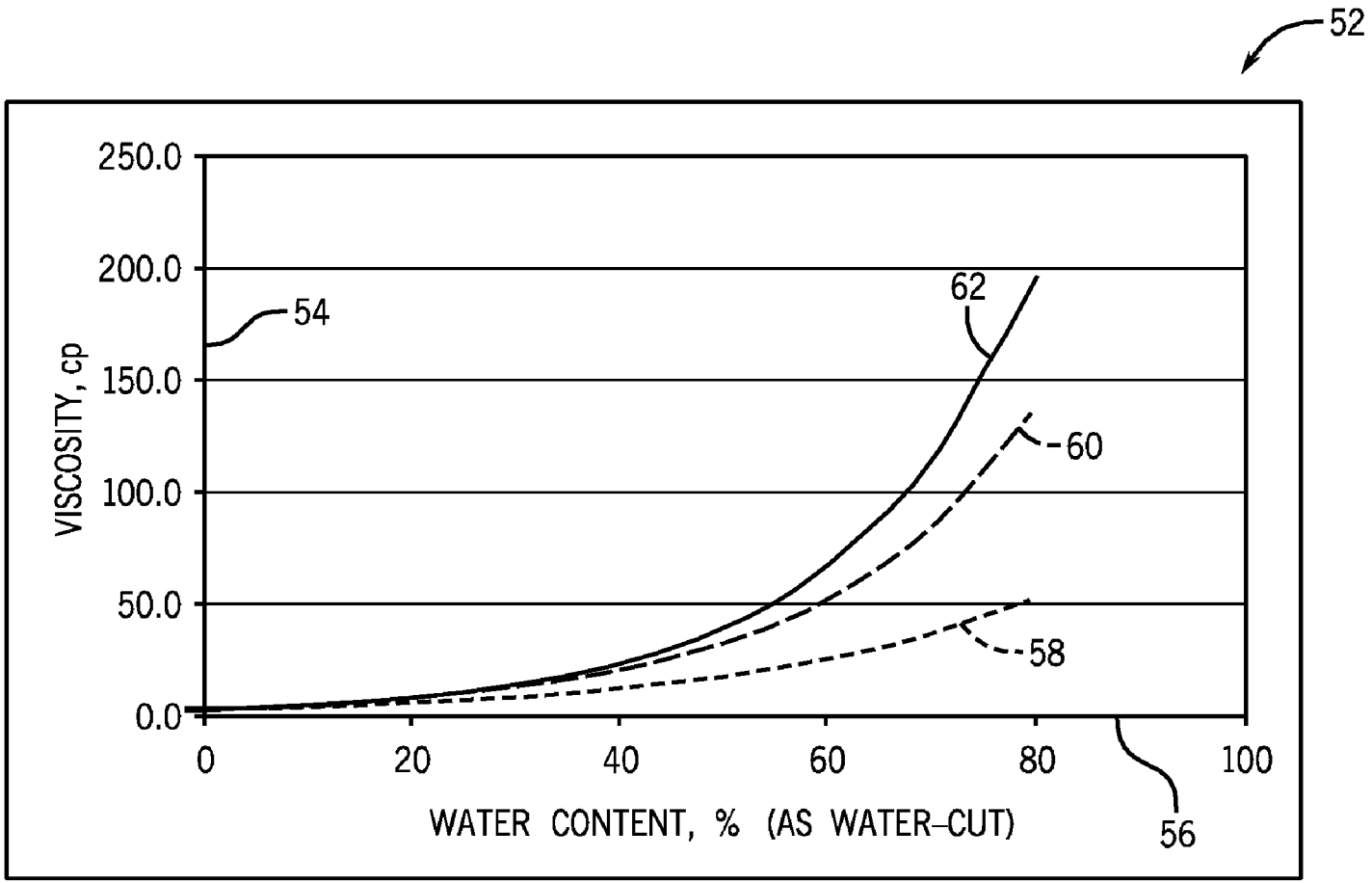
FIG. 2 is a chart of a relationship between water content and viscosity, in accordance with an exemplary embodiment of the present technique.

Referring generally to FIG. 2, a chart of the relationship between particle size and viscosity in a slurry is presented, and represented generally by reference numeral 52. The vertical axis 54 represents viscosity. The horizontal axis 56 represents the percentage of water in the slurry. There are three plots of viscosity versus water content for a slurry presented in FIG. 2: a first plot 58, a second plot 60, and a third plot 62. The three plots represent slurries having different particle sizes. The first plot 58 represents a slurry having particles of the smallest size. The second plot 60 represents a slurry having particles that are larger than the particles in the first plot 58. Finally, the third plot 62 represents a slurry having particles larger than the second plot 60. From the chart 52, it may be observed that the smaller the particle, the lower the viscosity.

In the illustrated embodiment, the instrumentation and control system 44 is adapted to reverse calculate particle size based on the water content and viscosity. The effective viscosity is obtained from the pressure drop detected by the multiphase flow meter 50. However, the viscosity may be established from another device.

In addition, tomography may be used to characterize the production fluid and/or slurry. Tomography is imaging that is performed in sections or by sectioning. Imaging technologies, such as microwave, MRI, NMR, ultrasound, may be used to provide imaging data of the slurry to enable the instrumentation and control system to establish the characteristics of the slurry. This enables the system to establish whether desired homogenous flow of slurry is being formed or a non-homogenous flow consistent with a poorly operating subcool liquid flow device is being formed.

Referring again to FIG. 1, a cooled gas 64 is injected into the bypass line 34 upstream of the recycle valve 42 via a cooled gas inlet 66 in the illustrated embodiment. The cooled gas 64 provides additional cooling of the slurry via Joules-Thompson expansion. The additional cooling provided by the cooled gas improves the ability of the system 20 to produce hydrate particles from the production fluid. In addition, the cooled gas 64 increases the velocity of the slurry. The increase in velocity improves the ability of the system 20 to produce small transportable hydrate particles.

Figure 3:
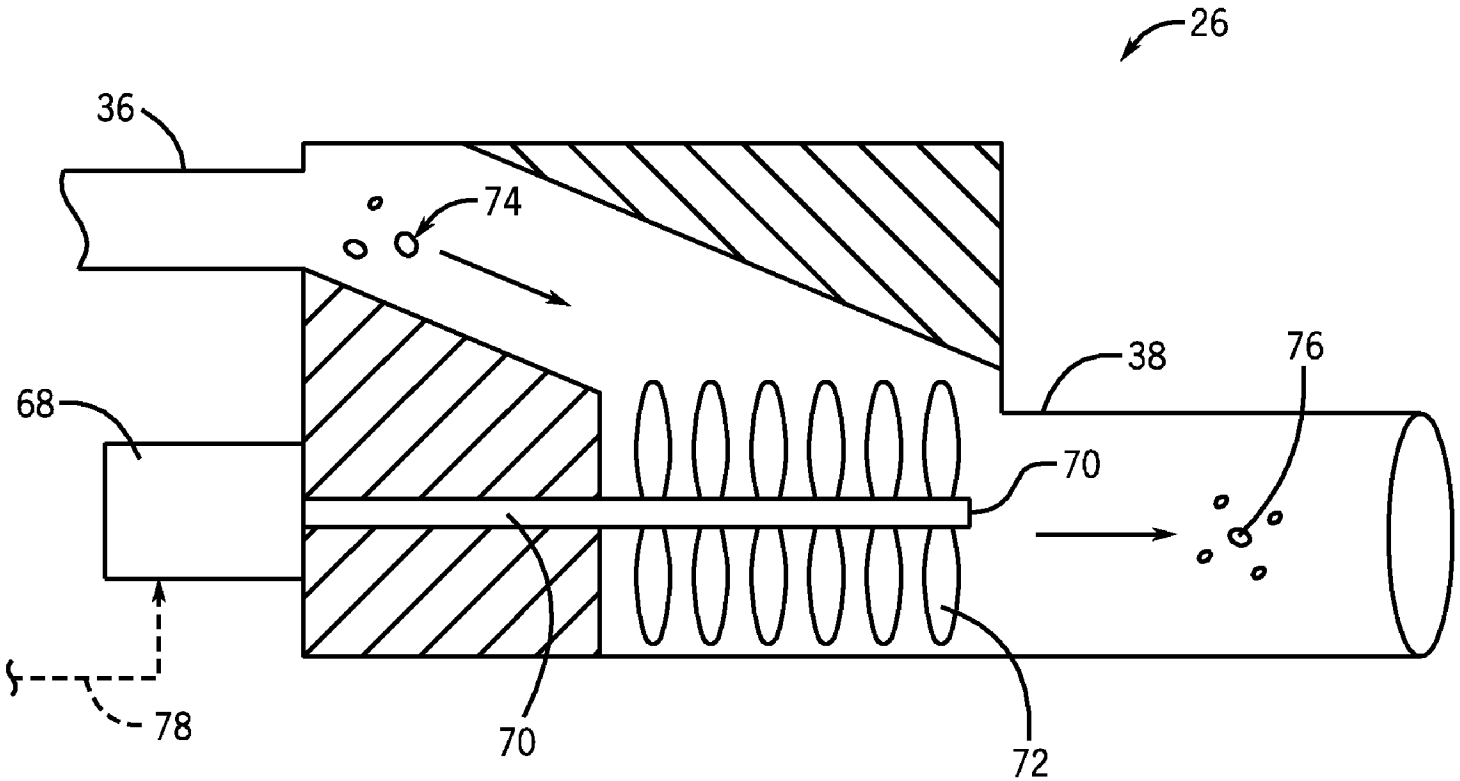
FIG. 3 is a cross-sectional view of a macerator pump of a system for producing a flow of production fluid from a wellbore that is cooled below the formation temperature for hydrates, in accordance with an exemplary embodiment of the present technique.

Referring generally to FIG. 3, the pump 30 is configured to enhance the reduction in size of the hydrate particles formed within the system 20. The pump 30 has a motor 68 with a drive shaft 70 coupled to an impeller 72 configured to macerate the hydrate particles. In particular, the impeller 72 in the illustrated embodiment is not a single impeller, but a series of impellers that are joined together in series along the shaft 70. Thus, a hydrate particle must pass through multiple impellers as it travels through the pump 30. As a result, hydrate particles 74 entering the pump 30 are shredded into smaller hydrate particles 76 by the blades of the impeller 72. In addition, the motor 68 of the pump 30 receives a control signal 78 from the instrumentation and control unit 48 in this embodiment. The control signal 78 is used to control the speed of the motor 68. The greater the speed of the motor 68, the greater the speed of the impeller 72. The greater the speed of the impeller 72, the greater the pressure produced by the pump 30 and the greater the shredding of hydrate particles.

Referring generally to FIG. 4, the cooling unit 32 utilizes a cooling coil 80 to facilitate heat transfer to the surrounding seawater 82. The cooling coil 80 is comprised of tubing 84 that is coiled around columns 86 of a structure 88. In addition, in this embodiment, the pump 30 and the other components of the sub-cooling system 20 are mounted on the structure 88. The structure 88 is located on the seafloor 90 in this embodiment.

Referring generally to FIG. 5, an alternative embodiment of a sub-cooling system is presented, represented generally by reference numeral 92. In this embodiment, the cooled gas 64 is injected downstream of the recycle valve 42. In this configuration, the cooled gas 64 produces a greater degree of sub-cooling of the production fluid. The flow of cooling gas 64 is controlled by a cooling gas control valve 94.

In this embodiment, the recycle valve 42 has been moved upstream of the cooling unit 32 and the discharge pressure control valve has been removed. Flow through the bypass line 34 is controlled by the recycle valve 42.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for producing a slurry of solid particles and production fluid from a subsea wellbore, comprising:

a pump having an inlet and a discharge, the pump adapted to be located on a sea floor with the inlet connected to a well production fluid source and the discharge coupled to a subsea flow line for pumping production fluid;

a bypass line that couples the discharge of the pump to the inlet of the pump for diverting at least a portion of the production fluid being discharged from the pump;

a cooling unit disposed in the bypass line and adapted to cool the production fluid flowing through the bypass line to a temperature at which hydrates may precipitate from the production fluid to produce a slurry of hydrate particles and production fluid at the inlet of the pump; and a controller for controlling the portion of the fluid being diverted to the cooling unit in response to at least one characteristic of the slurry.

2. The system as recited in claim 1, wherein the pump is configured to macerate the hydrate particles.

3. The system as recited in claim 1, means for dispensing a coolant gas into the bypass line between the cooling unit and the inlet of the pump to further cool the production fluid flowing through the bypass line.

4. The system as recited in claim 1, further comprising a sensor means for sensing a number of hydrate particles within the slurry of hydrate particles and production fluid and providing a signal to the controller.

5. The system as recited in claim 1, further comprising a sensor means for sensing rheological properties for the slurry of hydrate particles and production fluid and providing a signal to the controller.

6. The system as recited in claim 1, wherein further comprising a bypass throttle valve disposed in the bypass line between the cooling unit and the inlet of the pump and controlled by the controller to control flow through the bypass line.

7. The system as recited in claim 1, further comprising a discharge throttle valve disposed at the discharge of the pump downstream of where the bypass line couples to the discharge of the pump, the discharge throttle valve being controlled by the controller to control flow into the subsea flow line.

8. The system as recited in claim 1, further comprising a sensor means for sensing a hydrate particle size in the slurry and providing a signal to the controller.

9. A system for producing a slurry of hydrate particles and production fluid from a subsea wellbore, comprising:

a subsea pump having an inlet adapted to be coupled to a well production fluid source and a discharge adapted to be coupled to a subsea flow line;

a bypass line that couples the discharge of the pump to the inlet of the pump for diverting at least a portion of production fluid being pumped by the pump from the subsea flow line to the bypass line;

a cooling unit disposed in the bypass line, the cooling unit comprising a heat exchanger adapted to use sea water to cool production fluid within the cooling unit to a temperature at which hydrates may precipitate from the production fluid to produce a slurry of hydrate particles and production fluid for delivering to the inlet of the pump; and a controller for controlling the portion of production fluid diverted to the cooling unit.

10. The system as recited in claim 9, further comprising a sensor means for producing a signal to the controller representative of at least one characteristic of the slurry, and the controller is adapted to control the portion of production fluid diverted to the cooling unit based on the signal.

11. The system as recited in claim 9, wherein the heat exchanger of the cooling unit comprises a coil for receiving the production fluid flowing in the bypass line flows, the coil adapted to be immersed in sea water.

12. The system as recited in claim 9, further comprising a sensor means for producing a signal to the controller representative of hydrate particle size of the slurry, and the controller controls the portion of the production fluid diverted to the cooling unit based on the signal.

13. The system as recited in claim 9, further comprising a sensor means for producing a signal to the controller representative of hydrate particle quantity for a given sample size within the slurry, and the controller controls the portion of the production fluid diverted to the cooling unit based on the signal.

14. The system as recited in claim 9, further comprising a sensor means for producing a signal to the controller representative of a rheological property of the slurry, and the controller controls the portion of the production fluid diverted to the cooling unit based on the signal.

15. The system as recited in claim 9, further comprising a sensor means for producing a signal to the controller representative of a viscosity of the slurry, and the controller controls the portion of the production fluid diverted to the cooline unit based on the signal.

16. A method for producing a slurry of solid particles and production fluid having a desired characteristic, comprising:

flowing production fluid from a subsea well into an inlet of a subsea pump and pumping the production fluid into a discharge flow line leading to a desired location;

diverting at least a portion of the production fluid discharged from the pump to a subsea cooling unit and cooling said portion of production fluid with the cooling unit to a temperature at which hydrates may precipitate from the production fluid to produce a slurry of hydrate particles and production fluid;

feeding the slurry into the production fluid flowing to the inlet of the subsea pump and pumping the mixture of the slurry and the production fluid into the discharge flow line;

detecting at least one characteristic of the slurry of hydrate particles and production fluid; and controlling the portion of the production fluid diverted to the cooling unit based on the at least one characteristic of the slurry of hydrate particles and production fluid.

17. The method as recited in claim 16, wherein the at least one characteristic of the slurry of hydrate particles and production fluid comprises viscosity.

18. The method as recited in claim 16, wherein the at least one characteristic of the slurry of hydrate particles and production fluid comprises hydrate particle size.

19. The method as recited in claim 16, wherein the at least one characteristic of the slurry of hydrate particles and production fluid comprises hydrate particle quantity for a given sample size.

20. The method according to claim 16, further comprising with the pump macerating the hydrates precipitated by the cooling unit to produce smaller sizes of the hydrates.

21. The method according to claim 16, further comprising injecting a coolant gas into the production fluid and the slurry formed by the cooling unit before the production fluid and the slurry reach the inlet of the subsea pump.

* * * * *